US010546531B2

(12) United States Patent
Li

(10) Patent No.: US 10,546,531 B2
(45) Date of Patent: Jan. 28, 2020

(54) PIXEL CIRCUIT DRIVING METHOD AND DISPLAY DEVICE

(71) Applicant: BOE Technology Group Co., Ltd., Beijing (CN)

(72) Inventor: Quanhu Li, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 13 days.

(21) Appl. No.: 16/067,243

(22) PCT Filed: Jan. 4, 2018

(86) PCT No.: PCT/CN2018/071139
§ 371 (c)(1),
(2) Date: Jun. 29, 2018

(87) PCT Pub. No.: WO2018/205658
PCT Pub. Date: Nov. 15, 2018

(65) Prior Publication Data

US 2019/0325822 A1 Oct. 24, 2019

(30) Foreign Application Priority Data

May 12, 2017 (CN) ..... 2017 1 0336114

(51) Int. Cl.
*G09G 3/3233* (2016.01)
*G09G 3/3266* (2016.01)
(Continued)

(52) U.S. Cl.
CPC ..... *G09G 3/3233* (2013.01); *G09G 3/3258* (2013.01); *G09G 3/3266* (2013.01); *G09G 3/3275* (2013.01); *G09G 2300/0809* (2013.01)

(58) Field of Classification Search
CPC combination set(s) only.
See application file for complete search history.

(56) References Cited

U.S. PATENT DOCUMENTS

2009/0262102 A1 10/2009 Tanikame et al.
2014/0062843 A1 3/2014 Yang et al.
(Continued)

FOREIGN PATENT DOCUMENTS

CN 101114422 A 1/2008
CN 101325023 12/2008
(Continued)

OTHER PUBLICATIONS

International Search Report of the International Searching Authority corresponding to International Patent Application No. PCT/CN2018/071139, dated Apr. 3, 2018 (6 pages).
(Continued)

*Primary Examiner* — Robin J Mishler
(74) *Attorney, Agent, or Firm* — Myers Bigel, P.A.

(57) ABSTRACT

A method of driving a pixel circuit. The pixel circuit includes a light emitting element, a drive transistor, a storage capacitor connected between a gate and a source of the drive transistor, a first switch circuit, a second switch circuit, and a third switch circuit. The method includes: performing a data write phase including: bringing a second node out of conduction with the second power supply voltage by the first switch circuit, and charging the storage capacitor via the first switch circuit with a data voltage applied to the data line; performing a detection phase including directing a driving current generated by the drive transistor based on the data voltage to the sensing line via the third switch circuit; and detecting a magnitude of the driving current.

20 Claims, 7 Drawing Sheets

(51) Int. Cl.
*G09G 3/3258* (2016.01)
*G09G 3/3275* (2016.01)

(56) References Cited

U.S. PATENT DOCUMENTS

2015/0123953 A1* 5/2015 Shim ..... G09G 3/3233
345/205
2015/0145845 A1 5/2015 Nam et al.

FOREIGN PATENT DOCUMENTS

| | | | |
|---|---|---|---|
| CN | 102222468 | | 10/2011 |
| CN | 104637440 | A | 5/2015 |
| CN | 104658476 | | 5/2015 |
| CN | 104700773 | A | 6/2015 |
| CN | 105448238 | A | 3/2016 |
| CN | 106328061 | A | 1/2017 |
| CN | 106935192 | A | 7/2017 |

OTHER PUBLICATIONS

Written Opinion of the International Searching Authority with English language Translation corresponding to International Patent Application No. PCT/CN2018/071139, dated Apr. 3, 2018 (8 pages).
Chinese Office Action corresponding to Chinese Patent Application No. 201710336114.7 with English Language Translation, dated Aug. 3, 2018. (18 pages).

* cited by examiner

PIXEL CIRCUIT DRIVING METHOD AND DISPLAY DEVICE

CROSS REFERENCE TO RELATED APPLICATIONS

This application is the U.S. national phase entry of PCT/CN2018/071139, with an international filing date of Jan. 4, 2018, which claims the benefit of Chinese Patent Application No. 201710336114.7 filed on May 12, 2017, the entire disclosures of which are incorporated herein by reference.

TECHNICAL FIELD

The present disclosure relates to the field of display technology, and in particular, to a method of driving a pixel circuit, and a display device.

BACKGROUND

A pixel circuit in an organic light emitting diode (OLED) display implements a display function by controlling a driving current flowing through the OLED via a drive transistor. The magnitude of the driving current is related to characteristic parameters of the drive transistor, including the threshold voltage. The characteristic parameters of the drive transistor need to be compensated in order to avoid display defects due to the drift of the characteristic parameters of the drive transistor.

The compensation approaches may include internal compensation and external compensation. The internal compensation generally involves addition of new circuit elements in the pixel circuit to allow the driving current to be independent of the threshold voltage of the drive transistor. The internal compensation can be performed during the display operation of the pixel circuit. Therefore, the internal compensation can instantaneously follow a variation of the threshold voltage of the drive transistor, but cannot compensate for other characteristic parameters of the drive transistor. The external compensation generally involves the use of an external circuit to detect the characteristic parameters of the drive transistor and adjust a data voltage supplied to the pixel circuit based on the detection. The detection of the characteristic parameters requires special drive timing and is typically only performed during non-display operations of the pixel circuit, for example, when the display is powering up or down. Therefore, the external compensation cannot follow the variation of the threshold voltage instantaneously. This may affect the effect of compensation.

SUMMARY

It would be advantageous to provide a mechanism that can alleviate, mitigate, or eliminate at least one of the above problems.

According to an aspect of the present disclosure, a method of driving a pixel circuit is provided. The pixel circuit comprises: a light emitting element connected between a first node and a first power supply voltage; a drive transistor connected between the first node and a second node, the drive transistor comprising a gate, a source, and a drain, the gate being connected to a third node; a storage capacitor connected between the gate and the source of the drive transistor; a first switch circuit connected to a third scan line, a second power supply voltage, and the second node, the first switch circuit being configured to supply the second power supply voltage to the second node in response to a third scan signal on the third scan line being active; a second switch circuit connected to a first scan line, a data line, and the third node, the second switch circuit being configured to supply a voltage on the data line to the third node in response to a first scan signal on the first scan line being active; and a third switch circuit connected to a second scan line, a sensing line, and the first node, the third switch circuit being configured to couple the first node to the sensing line in response to a second scan signal on the second scan line being active. The method comprises: performing a data write phase comprising: bringing, by the first switch circuit, the second node out of conduction with the second power supply voltage by deactivating the third scan signal on the third scan line; and charging the storage capacitor via the second switch circuit with a data voltage applied to the data line by activating the first scan signal on the first scan line, and performing a detection phase comprising: directing, via the third switch circuit, a driving current generated by the drive transistor based on the data voltage to the sensing line by activating the third scan signal on the third scan line and the second scan signal on the second scan line; and detecting a magnitude of the driving current.

In certain exemplary embodiments, the drive transistor is an N-type transistor, the source of the drive transistor is connected to the first node, and the drain of the drive transistor is connected to the second node.

In certain exemplary embodiments, the performing the data write phase further comprises supplying, via the third switch circuit, a reference voltage applied to the sensing line to the first node by activating the second scan signal on the second scan line.

In certain exemplary embodiments, the method further comprises performing a reset phase and an internal compensation phase prior to the data write phase. The performing the reset phase comprises: supplying, via the second switch circuit, a reset voltage applied to the data line to the third node by activating the first scan signal on the first scan line; and supplying, via the third switch circuit, a reference voltage applied to the sensing line to the first node by activating the second scan signal on the second scan line. The performing the internal compensation phase comprises charging the storage capacitor via the second switch circuit with a charging voltage applied to the data line by activating the third scan signal on the third scan line, by deactivating the second scan signal on the second scan line, and by activating the first scan signal on the scan line. The performing the data write phase further comprises deactivating the second scan signal on the second scan line.

In certain exemplary embodiments, the charging the storage capacitor with the charging voltage comprises: in a first period of time, charging the storage capacitor with a first charging voltage by applying the first charging voltage to the data line; and in a second period of time subsequent to the first period of time, charging the storage capacitor with a second charging voltage by applying the second charging voltage to the data line. The first charging voltage is greater than the second charging voltage, and the second charging voltage is greater than a threshold voltage of the drive transistor.

In certain exemplary embodiments, the performing the detection phase further comprises: deriving a threshold voltage of the drive transistor based on the detected magnitude of the driving current; and determining whether an internal compensation condition is satisfied. The internal compensation condition comprises: a change rate of the threshold voltage being greater than a change rate threshold, and a change amount of the threshold voltage being smaller than a change amount threshold. The method further comprises: responsive to the internal compensation condition being satisfied, sequentially performing a reset phase, an internal compensation phase, the data write phase, and a light emission phase in each frame period during a display operation, wherein the performing the data write phase further comprises deactivating the second scan signal on the second scan line; and responsive to the internal compensation condition being not satisfied, sequentially performing the reset phase, the data write phase, and the light emission phase in each frame period during the display operation, wherein the performing the data write phase further comprises supplying, via the third switch circuit, a reference voltage applied to the sensing line to the first node by activating the second scan signal on the second scan line.

In certain exemplary embodiments, the performing the light emission phase comprises driving the light emitting element to emit light with the driving current generated by the drive transistor by deactivating the first scan signal on the first scan line, by deactivating the second scan signal on the second scan line, and by activating the third scan signal on the third scan line.

According to another aspect of the present disclosure, a display device is provided comprising: a first scan driver configured to sequentially supply first scan signals to a plurality of first scan lines; a second scan driver configured to sequentially supply second scan signals to a plurality of second scan lines; a third scan driver configured to sequentially supply third scan signals to a plurality of third scan lines; a data driver configured to generate output voltages based on input data and apply the generated output voltages to a plurality of data lines; a pixel array comprising a plurality of pixel circuits arranged in an array, each of the pixel circuits comprising: a light emitting element connected between a first node and a first power supply voltage; a drive transistor connected between the first node and a second node, the drive transistor comprising a gate, a source, and a drain, the gate being connected to a third node; a storage capacitor connected between the gate and the source of the drive transistor; a first switch circuit connected to a corresponding one of the plurality of third scan lines, a second power supply voltage, and the second node, the first switch circuit being configured to supply the second power supply voltage to the second node in response to the third scan signal on the corresponding third scan line being active; a second switch circuit connected to a corresponding one of the plurality of first scan lines, a corresponding one of the plurality of data lines, and the third node, the second switch circuit being configured to supply a voltage on the corresponding data line to the third node in response to the first scan signal on the corresponding first scan line being active; and a third switch circuit connected to a corresponding one of the plurality of second scan lines, a corresponding one of the plurality of sensing lines, and the first node, the third switch circuit being configured to couple the first node to the corresponding sensing line in response to the second scan signal on the corresponding second scan line being active; a plurality of detection circuits each connected to a corresponding one of the plurality of sensing lines, each of the plurality of detection circuits being configured to detect a driving current generated by the drive transistor and transferred by the corresponding sensing line; and a timing controller configured to control operations of the first, second, and third scan drivers, the data driver, and the plurality of detection circuits. The timing controller, the first, second, and third scan drivers, the data driver, and the plurality of detection circuits are configured to perform operations for each of the plurality of pixel circuits, the operations comprising: performing a data write phase in which: the third scan driver is configured to supply an inactive third scan signal to the corresponding third scan line such that the first switch circuit brings the second node out of conduction with the second power supply voltage; and the first scan driver is configured to supply an active first scan signal to the corresponding first scan line and the data driver is configured to apply a data voltage to the corresponding data line such that the storage capacitor is charged with the data voltage via the second switch circuit; and performing a detection phase in which: the third scan driver is configured to supply an active third scan signal to the corresponding third scan line and the second scan driver is configured to supply an active second scan signal to the corresponding second scan line such that the driving current generated by the drive transistor based on the data voltage is directed to the corresponding sensing line via the third switch circuit, and a corresponding one of the plurality of detection circuits is configured to detect a magnitude of the driving current.

These and other aspects of the present disclosure will be apparent from and elucidated with reference to the embodiment(s) described hereinafter.

BRIEF DESCRIPTION OF THE DRAWINGS

Further details, features, and advantages of the present disclosure are disclosed in the following description of exemplary embodiments in connection with the accompanying drawings, in which.

DETAILED DESCRIPTION

It will be understood that, although the terms first, second, third etc. may be used herein to describe various elements, components and/or sections, these elements, components and/or sections should not be limited by these terms. These terms are only used to distinguish one element, component or section from another element, component or section. Thus, a first element, component or section discussed below could be termed a second element, component or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element is referred to as being "connected to" or "coupled to" another element, it can be directly connected or coupled to the other element, or intervening elements may be present. In contrast, when an element is referred to as being "directly connected to" or "directly coupled to" another element, there are no intervening elements present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 1:
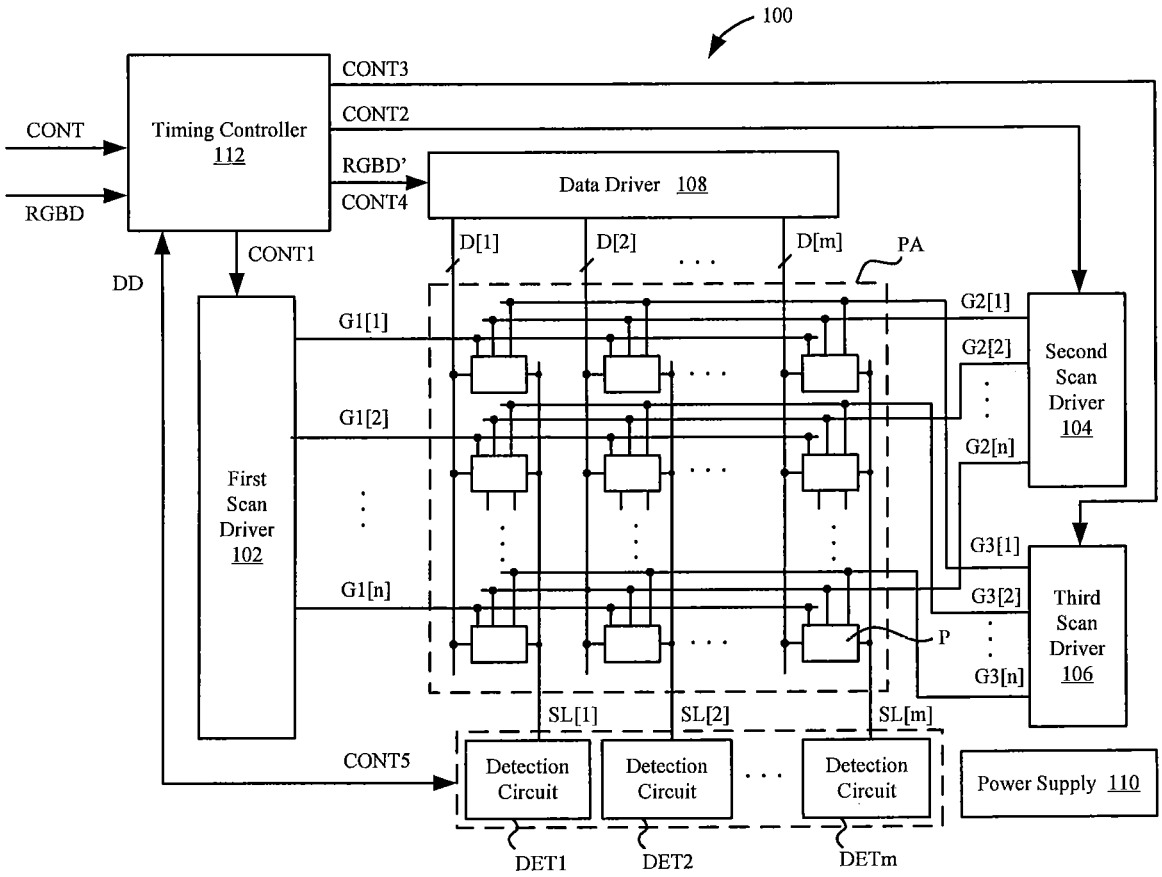
FIG. 1 is a schematic block diagram of a display device according to an embodiment of the present disclosure.

FIG. 1 is a schematic block diagram of a display device 100 according to an embodiment of the present disclosure. Referring to FIG. 1, the display device 100 includes a pixel array PA, a first scan driver 102, a second scan driver 104, a third scan driver 106, a data driver 108, a plurality of detection circuits DET1, DET2, . . . , DETm, a power supply 110, and a timing controller 112. By way of example and not limitation, the display device 100 may be any product or component having a display function such as a mobile phone, a tablet computer, a television, a monitor, a notebook computer, a digital photo frame, a navigator, and the like.

The pixel array PA includes n×m pixel circuits P. Each pixel circuit P may include a light emitting element (not shown in FIG. 1). The pixel array PA includes n first scan lines G1[1], G1[2], . . . , G1[*n*] arranged in a row direction to transfer first scan signals, n second scan lines G2[1], G2[2], . . . , G2[*n*] arranged in the row direction to transfer second scan signals, n third scan lines G3[1], G3[2], . . . , G3[*n*] arranged in the row direction to transfer third scan signals, m data lines D[1], D[2], . . . , D[m] arranged in a column direction to transfer data signals, m sensing lines SL[1], SL[2], . . . , SL[m] arranged in the column direction to draw driving currents from the pixel circuits P, and wires (not shown) for applying first and second power supply voltages ELVSS and ELVDD. n and m are natural numbers.

The first scan driver 102 is connected to the first scan lines G1[1], G1[2], . . . , G1[*n*] to apply the first scan signals to the pixel array PA. The second scan driver 104 is connected to the second scan lines G2[1], G2[2], . . . , G2[*n*] to apply the second scan signals to the pixel array PA. The third scan driver 106 is connected to the third scan lines G3[1], G3[2], . . . , G3[*n*] to apply the third scan signals to the pixel array PA. The data driver 108 is connected to the data lines D[1], D[2], . . . , D[m] to apply data signals to the pixel array PA. The detection circuits DET1, DET2, . . . , DETm are respectively connected to the sensing lines SL[1], SL[2], . . . , SL[m] to detect the driving currents drawn from the pixel circuits P. The first and second power supply voltages ELVSS and ELVDD (not shown in FIG. 2) supplied from the power supply 110 are applied to each of the pixel circuits P in the pixel array PA.

The timing controller 112 is used to control the operations of the first scan driver 102, the second scan driver 104, the third scan driver 106, the data driver 108, and the detection circuits DET1, DET2, . . . , DETm. The timing controller 112 receives input image data RGBD and an input control signal CONT from an external device (e.g., a host), and receives detection data DD from the detection circuits DET1, DET2, . . . , DETm. The input image data RGBD may include a plurality of input pixel data for the plurality of pixels. Each input pixel data may include red gray data R, green gray data G, and blue gray data B for a respective one of the plurality of pixels. The input control signal CONT may include a master clock signal, a data enable signal, a vertical synchronization signal, a horizontal synchronization signal, and the like. The timing controller 112 generates output image data RGBD', a first control signal CONT1, a second control signal CONT2, a third control signal CONT3, a fourth control signal CONT4, and a fifth control signal CONT5 based on the input image data RGBD, the detection data DD, and the input control signal CONT.

Specifically, the timing controller 112 may generate the output image data RGBD' based on the input image data RGBD and the detection data DD. The output image data RGBD' is supplied to the data driver 108. The output image data RGBD' may be compensated image data generated by compensating the input image data RGBD using a compensation algorithm. In addition, the first control signal CONT1, the second control signal CONT2, and the third control signal CONT3 are respectively provided to the first scan driver 102, the second scan driver 104, and the third scan driver 106, and the drive timings of the first, second, and third scan drivers 102, 104, and 106 are controlled based on the first, second, and third control signals CONT1, CONT2, and CONT3, respectively. The first, second, and third control signals CONT1, CONT2, and CONT3 may include vertical start signals, gate clock signals, and the like. The fourth control signal CONT4 is supplied to the data driver 108 and the driving timing of the data driver 108 is controlled based on the fourth control signal CONT4. The fourth control signal CONT4 may include a horizontal start signal, a data clock signal, a data load signal, and the like. The fifth control signal CONT5 is provided to the detection circuits DET1, DET2, . . . , DETm, and the drive timings of the detection circuits DET1, DET2, . . . , DETm are controlled based on the fifth control signal CONT5. For example, the detection circuits DET1, DET2, . . . , DETm may be controlled to detect, during the detection phase, the driving currents generated by the corresponding pixel circuits P and transferred via the sensing lines SL[1], SL[2], . . . , SL[m].

The first scan driver 102 generates from the first control signal CONT1 a plurality of scan signals that are sequentially applied to the first scan lines G1[1], G1[2], . . . , G1[*n*]. The second scan driver 104 generates from the second control signal CONT2 a plurality of scan signals that are sequentially applied to the second scan lines G2[1], G2[2], . . . , G2[*n*]. The third scan driver 106 generates from the third control signal CONT3 a plurality of scan signals that are sequentially applied to the third scan lines G3[1], G3[2], . . . , G3[*n*].

The data driver 108 receives the fourth control signal CONT4 and the output image data RGBD' from the timing controller 112. The data driver 108 generates a plurality of data voltages based on the fourth control signal CONT4 and the output image data RGBD'. The data driver 108 may apply the plurality of data voltages to the data lines D[1], D[2], . . . , D[m].

The detection circuits DET1, DET2, . . . , DETm are connected to the respective sensing lines SL[1], SL[2], . . . , SL[m] and receive the fifth control signal CONT5 from the timing controller 112. Each of the detection circuits DET1, DET2, . . . , DETm detects the driving current transferred via a respective sensing line based on the fifth control signal CONT5.

Figure 2:
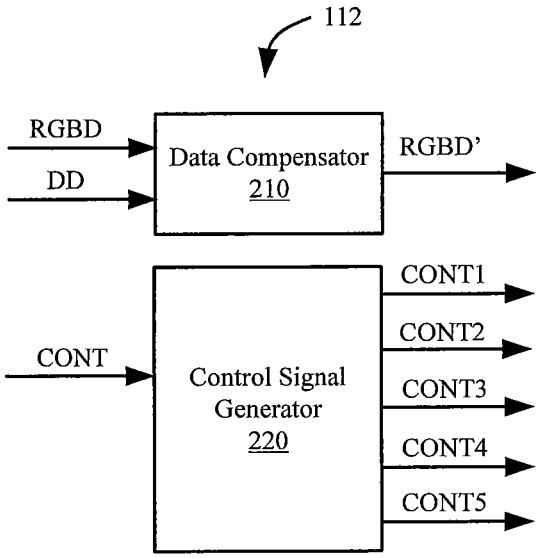
FIG. 2 is a schematic block diagram of a timing controller in the display device shown in FIG. 1.

FIG. 2 is a schematic block diagram of a timing controller 112 in the display device 100 shown in FIG. 1. Referring to FIG. 2, the timing controller 112 includes a data compensator 210 and a control signal generator 220. For ease of description, the timing controller 112 is shown in FIG. 2 as being divided into two elements, although the timing controller 112 may not be physically divided.

The data compensator 210 compensates the input image data RGBD based on the detection data DD from the plurality of detection circuits DET1, DET2, . . . , DETm to generate compensated output image data RGBD'. For example, the value of the driving current detected, when given image data is supplied to the data driver 108, can be compared with an ideal current value, and the compensation value for the given image data can be determined from the comparison result. The compensation is such that the pixel circuit P operates at an ideal driving current corresponding to the image data. This is so-called "external compensation." The algorithm of the external compensation is beyond the scope of this document and any known or future algorithm in the art can be used.

The control signal generator 220 receives the input control signal CONT from an external device, and generates the control signals CONT1, CONT2, CONT3, CONT4, and CONT5 shown in FIG. 1 based on the input control signal CONT. The control signal generator 220 outputs the control signals CONT1, CONT2, CONT3, CONT4, and CONT5 to the first scan driver 102, the second scan driver 104, the third scan driver 106, the data driver 108, and the detection circuits DET1, DET2, . . . , DETm shown in FIG. 1, respectively.

The timing controller 112 may be implemented in many ways (e.g., such as using dedicated hardware) in order to perform the various functions discussed herein. A "processor" is one example of the timing controller 112 that employs one or more microprocessors that can be programmed using software (e.g., microcode) in order to perform the various functions discussed herein. The timing controller 112 may be implemented with or without a processor and may also be implemented as dedicated hardware to perform some functions and a processor to perform other functions (e.g., a combination of one or more programmed microprocessors and associated circuitry).

Examples of the controller 112 that may be employed in various embodiments of the present disclosure include, but are not limited to, conventional microprocessors, application specific integrated circuits (ASICs), and field programmable gate arrays (FPGAs).

Figure 3A:
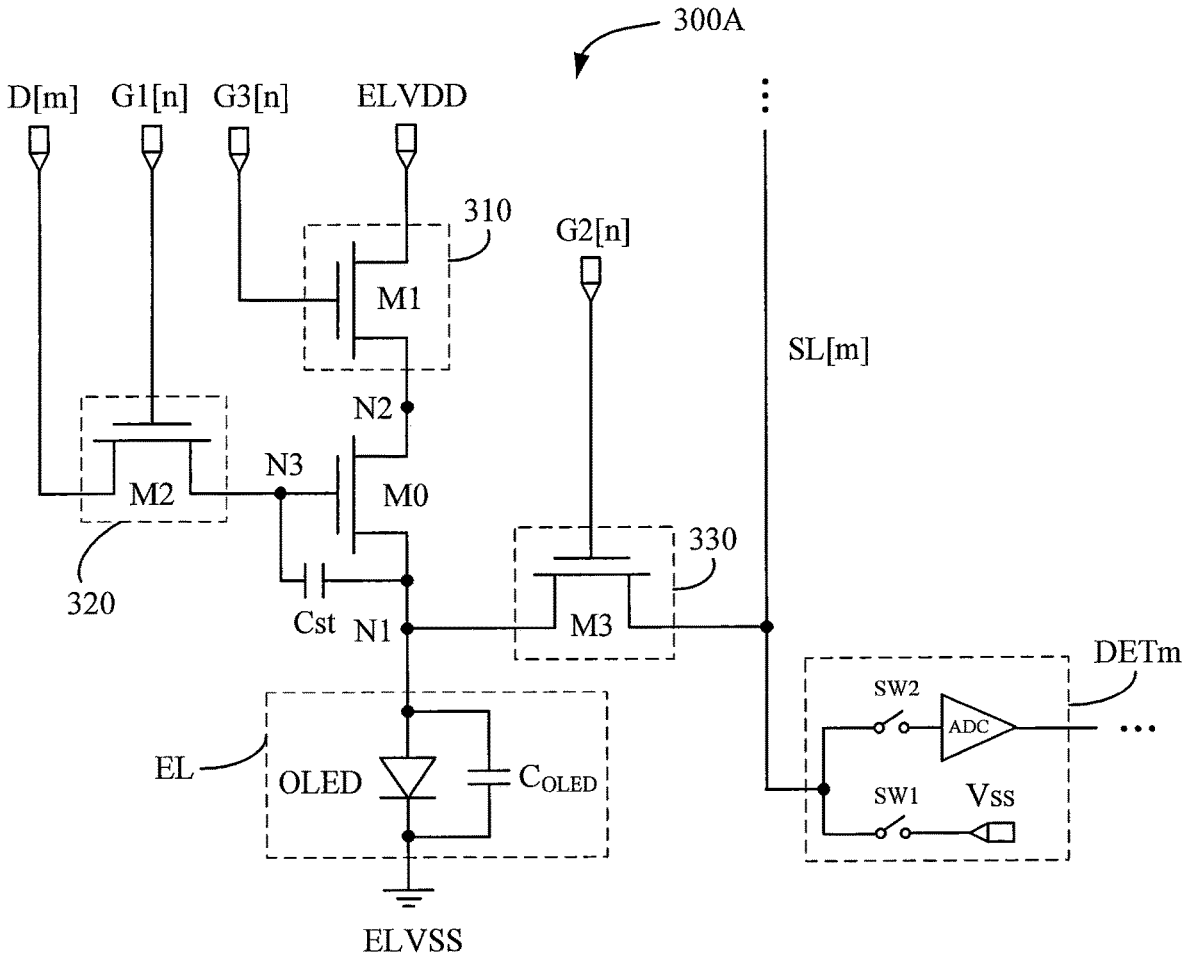
FIG. 3A is a schematic circuit diagram of a pixel circuit in the display device shown in FIG. 1.

FIG. 3A shows an example circuit 300A of the pixel circuit P in the display device shown in FIG. 1. For ease of description, a pixel circuit is shown that is connected to the nth first scan line G1[*n*], the nth second scan line G2[*n*], the nth third scan line G3[*n*], the mth data line D[m], and the mth sensing line SL[m]. As shown in FIG. 3A, the pixel circuit 300A includes a light emitting element EL, a drive transistor M0, a storage capacitor Cst, a first switch circuit 310, a second switch circuit 320, and a third switch circuit 330.

The light emitting element EL is connected between a first node N1 and the first power supply voltage ELVSS. In this embodiment, the light emitting element EL is an organic light emitting diode (OLED) having an equivalent capacitor COLED connected in parallel across the OLED. In other embodiments, the light emitting element EL may of course be other types of electroluminescent elements.

The drive transistor M0 is connected between the first node N1 and a second node N2. The drive transistor M0 includes a gate, a source, and a drain, and the gate is connected to a third node N3. In this embodiment, the drive transistor M0 is an N-type transistor, with its source connected to the first node N1 and its drain connected to the second node N2.

The storage capacitor Cst is connected between the gate and the source of the drive transistor M0.

The first switch circuit 310 is connected to the third scan line G3[*n*], the second power supply voltage ELVDD, and the second node N2. The first switch circuit 310 is configured to supply the second power supply voltage ELVDD to the second node N2 in response to a third scan signal on the third scan line G3[*n*] being active. In this embodiment, the first switch circuit 310 includes a first transistor M1 having a gate connected to the third scan line G3[*n*], a first electrode connected to the second power supply voltage ELVDD, and a second electrode connected to the second node N2.

The second switch circuit 320 is connected to the first scan line G1[*n*], the data line D[m], and the third node N3. The second switch circuit 320 is configured to supply a voltage on the data line D[m] to the third node N3 in response to a first scan signal on the first scan line G1[*n*] being active. In this embodiment, the second switch circuit 320 includes a second transistor M2 having a gate connected to the first scan line G1[*n*], a first electrode connected to the data line D[m], and a second electrode connected to the third node N3.

The third switch circuit 330 is connected to the second scan line G2[*n*], the sensing line SL[m], and the first node N1. The third switch circuit 330 is configured to couple the first node N1 to the sensing line SL[m] in response to a second scan signal on the second scan line G2[*n*] being active. In this embodiment, the third switch circuit 330 includes a third transistor M3 having a gate connected to the second scan line G2[*n*], a first electrode connected to the sensing line SL[m], and a second electrode connected to the first node N1.

It will be understood that the phrase "signal being active" as used herein means that the signal is at such a potential that it can enable the circuit element (e.g., a transistor) involved. For example, for an N-type transistor, the active potential is high, and for a P-type transistor, the active potential is low.

Continuing with the example of FIG. 3A, the detection circuit DETm connected to the sensing line SL[m] is also shown. The detection circuit DETm may be used to detect the driving current generated by the drive transistor M0 and transferred via the sensing line SL[m]. The detection of the driving current can be achieved by sampling a voltage generated by the driving current charging the capacitance presented on the sensing line SL[m]. Specifically, the detection circuit DETm includes a second controlled switch SW2 and an analog-to-digital converter ADC that are connected in series. The second controlled switch SW2 may couple the voltage on the sensing line SL[m] to the analog-to-digital converter ADC, which in turn converts the voltage into digital data DD and provides the digital data DD to the timing controller 112 shown in FIG. 1. The detection circuit DETm may further include a first controlled switch SW1 that couples the sensing line SL[m] to a reference voltage Vss. The combination of the first controlled switch SW1 and the third transistor M3 can be used to set the first node N1 at the reference voltage Vss.

Figure 3B:
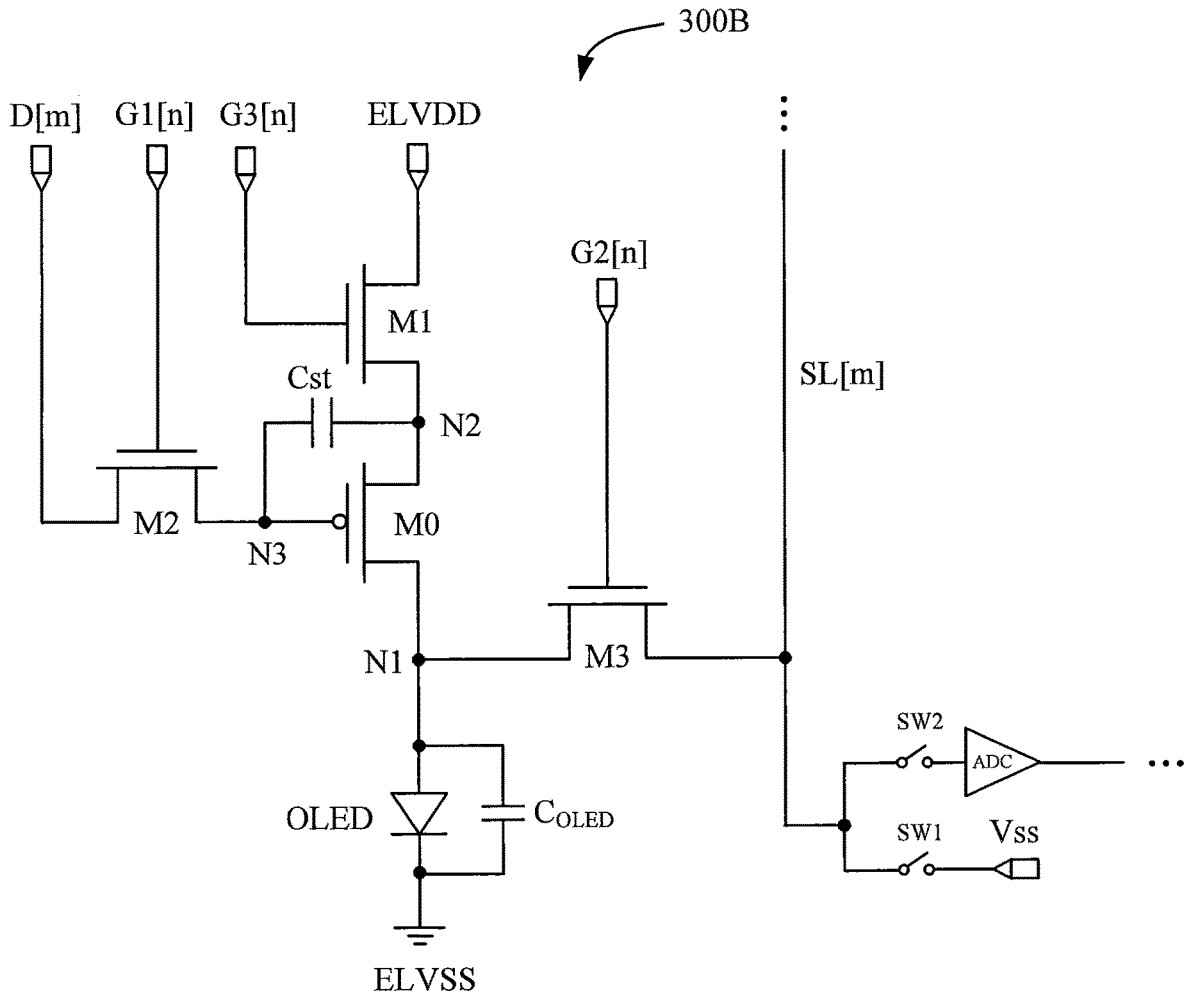
FIG. 3B is another schematic circuit diagram of a pixel circuit in the display device shown in FIG. 1.

FIG. 3B shows another example circuit 300B of the pixel circuit P in the display device shown in FIG. 1. The same reference numerals as in FIG. 3A indicate the same elements. The pixel circuit 300B is different from the pixel circuit 300A in that the drive transistor M0 is now a P-type transistor. Accordingly, the source of the drive transistor M0 is connected to the second node N2, and the drain of the drive transistor M0 is connected to the first node N1. Although the storage capacitor Cst is illustrated in FIG. 3B as having one terminal directly connected to the third node N3 and another terminal directly connected to the second node N2, in other embodiments the storage capacitor Cst may have one terminal directly connected to the third node N3 and another terminal directly connected to the second power supply voltage ELVDD.

In FIGS. 3A and 3B, the first, second, and third transistors M1, M2, and M3 are illustrated as N-type transistors, although P-type transistors are possible. In the case of a P-type transistor, the gate-on voltage is a low-level voltage, and the gate-off voltage is a high-level voltage.

The operation of the pixel circuit 300A of FIG. 3A will be described below with reference to FIGS. 4-8, wherein FIGS. 4-5 relate to the operation of the pixel circuit 300A for the external compensation during a non-display operation, and FIGS. 7-8 relate to the operation of the pixel circuit 300A during a display operation. The term "display operation" as used herein refers to actions performed by the pixel circuit for displaying an image data element. In this sense, the "non-display operation" refers to actions performed by the pixel circuit that are not directly related to displaying an image data element. Therefore, the actions performed by the pixel circuit during, for example, an H-blank interval or during power-up or power-down may be interpreted as the non-display operation. The external compensation is typically performed during the non-display operation while the internal compensation is performed during the display operation.

Figure 4:
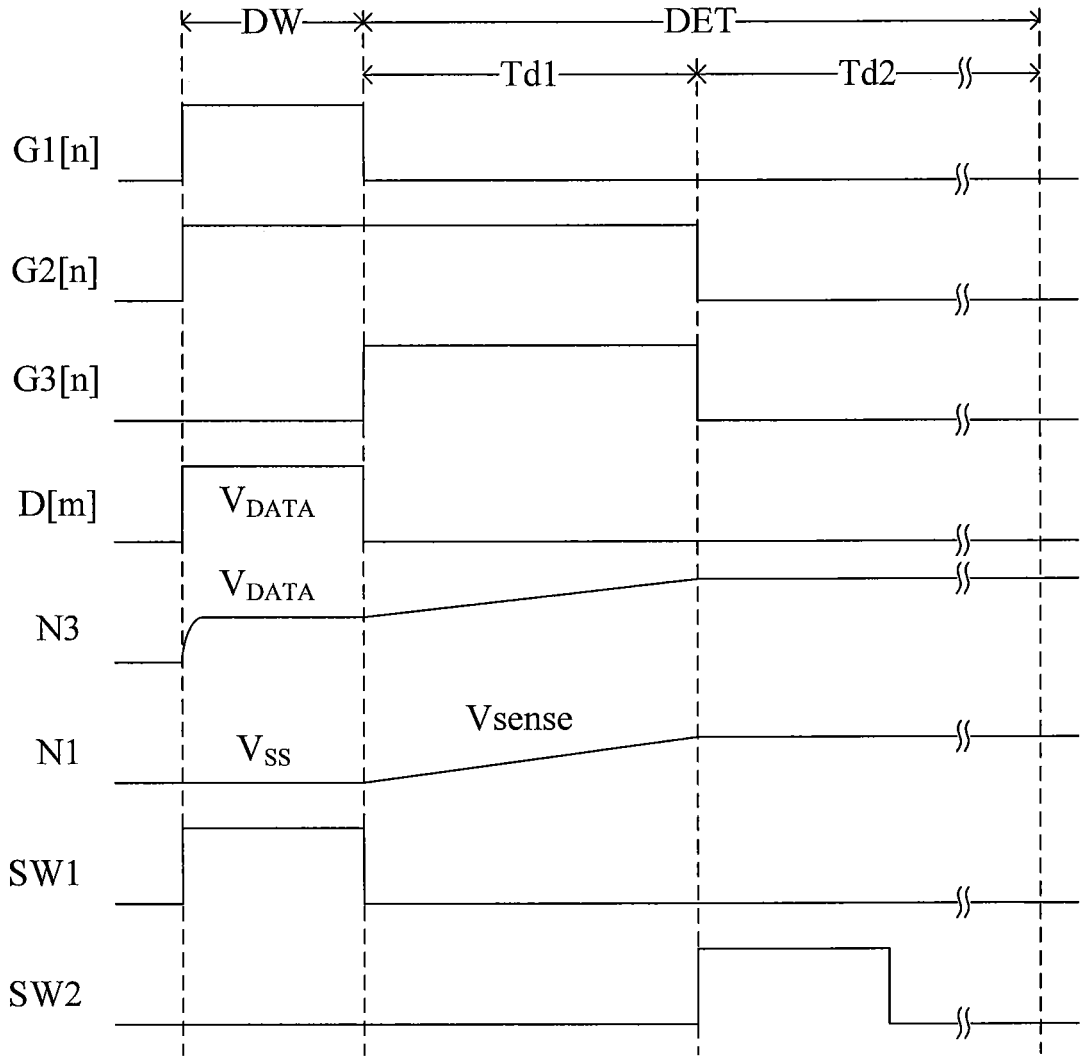
FIG. 4 is a timing diagram for the pixel circuit shown in FIG. 3A during a non-display operation.

FIG. 4 shows the operation of the pixel circuit 300A shown in FIG. 3A for the external compensation during a non-display operation.

In a data write phase DW, the signal on the first scan line G1[$n$] is active, so that the data voltage $V_{DATA}$ on the data line D[m] is supplied to the third node N3 (i.e., the gate of the drive transistor M0) through the second transistor M2. The signal on the second scan line G2[$n$] is active and the first controlled switch SW1 is turned on so that the reference voltage Vss (which generally has a low level) is supplied to the first node N1 (i.e., the source of the drive transistor M0) through the first controlled switch SW1 and the third transistor M3. This can provide a reliable reference level for the data voltage $V_{DATA}$ written to the third node N3. The data voltage $V_{DATA}$ is then written in the storage capacitor Cst. In particular, during the data write phase DW, the signal on the third scan line G3[$n$] is inactive, so that the first transistor M1 is turned off. The presence of the first transistor M1 may provide an additional advantage in that the turned-off first transistor M1 prevents the driving current from flowing through the drive transistor M0, thereby preventing variation of the potential at the first node N1. This can increase the accuracy of the data voltage $V_{DATA}$ being written and therefore the accuracy of the compensation.

In a detection phase DET that follows, the signal on the third scan line G3[$n$] is active and the signal on the second scan line G2[$n$] remains active. This allows the driving current generated by the drive transistor M0 to be coupled to the sensing line SL[m] via the third transistor M3 and charge the capacitance presented on the sensing line SL[m]. As shown in FIG. 4, during a first period Td1 of the detection phase DET, the potential Vsense at the first node N1 gradually increases. The driving current does not flow through the OLED but is transferred to the sensing line SL[m] because the data voltage $V_{DATA}$ written in the data write phase DW is selected such that Vsense is typically smaller than a turned-on voltage of the OLED. In a second period Td2 of the detection phase DET, the signal on the second scan line G2[$n$] is inactive, such that the sensing line SL[m] is disconnected from the pixel circuit 300A and the second controlled switch SW2 is turned on. The voltage Vsense on the sensing line SL[m] line is sampled by the analog-to-digital converter ADC and passed to the timing controller 112 shown in FIG. 1. As described above, the timing controller 112 may compensate the image data supplied to the data driver 108 based on the sampled value of the voltage Vsense.

The driving current $I_D$ generated by the drive transistor M0 can be expressed as:

$$I_D = \frac{1}{2}K \times (Vgs - Vth)^a \tag{1}$$

where $$K = \frac{W}{L} \cdot C \cdot \mu,$$

μ is a carrier mobility of the drive transistor M0, C is a capacitance of a gate insulating layer of the drive transistor M0, and W/L is a ratio of width-to-length of the channel of the drive transistor M0, a is an empirical parameter which generally has a value of 2, Vgs is a gate-source voltage of the drive transistor M0, and Vth is a threshold voltage of the drive transistor M0.

In practice, the timing controller 112 may derive one or more of the threshold voltage Vth of the drive transistor M0 and the parameters K and a using the compensation algorithm and equation (1) based on the detection of the voltage Vsense. Such a compensation algorithm is beyond the scope of this document and any known or future compensation algorithm may be used herein for the derivation.

Figure 5:
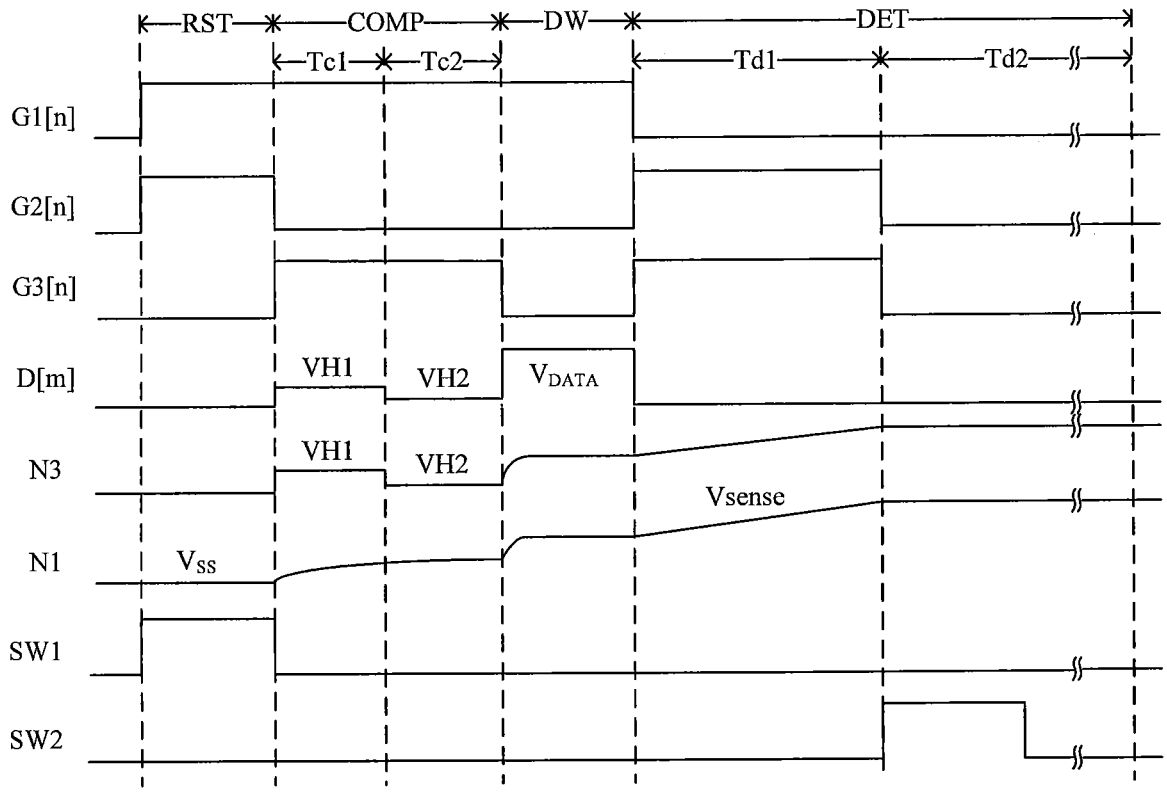
FIG. 5 is another timing diagram for the pixel circuit shown in FIG. 3A during a non-display operation.

FIG. 5 shows the operation of the pixel circuit 300A shown in FIG. 3A for the external compensation in combination with the internal compensation during a non-display operation.

In a reset phase RST, the signal on the first scan line G1[$n$] is active, so that a reset voltage (e.g., a low level voltage) on the data line D[m] is supplied to the third node N3 (i.e., the gate of the drive transistor M0) through the second transistor M2. The signal on the second scan line G2[$n$] is active and the first controlled switch SW1 is turned on, so that the reference voltage Vss is supplied to the first node N1 (i.e., driving Source of transistor M0) through the first controlled switch SW1 and the third transistor M3. The voltage across the storage capacitor Cst is then reset. In particular, during the reset phase RST, the signal on the third scan line G3[$n$] is inactive, such that the first transistor M1 is turned off. The presence of the first transistor M1 may provide an additional advantage in that the turned-off first transistor M1 prevents the driving current from flowing through the drive transistor M0, thereby preventing variation of the potential at the first node N1. This can provide a reliable reset of the voltage across the storage capacitor Cst.

In an internal compensation phase COMP that follows, the signal on the first scan line G1[n] is active, so that the storage capacitor Cst is charged via the second transistor M2 with a charging voltage VH on the data line D[m]. The signal on the third scan line G3[n] is active, and the signal on the second scan line G2[n] is inactive. The drive transistor M0 generates a driving current at the charging voltage VH (VH>Vth). Due to the presence of the capacitor Cst, the driving current charges the first node N1, and thus the potential at the first node N1 gradually increases. In an ideal case (e.g., when the duration of the internal compensation phase COMP is long enough), the potential at the first node N1 may increase up to (VH−Vth). In this case, the gate-source voltage of the drive transistor M0 is equal to Vth, and thus the drive transistor M0 is in a critical state between saturation and off. Then, the internal compensation is completed.

The internal compensation used herein may be referred to as "source-following" compensation because the potential at the source of the drive transistor M0 (or the first node N1) increases with the potential at the gate of the drive transistor M0 during the compensation process. Such an internal compensation may be advantageous in that no additional circuit elements are needed to put the drive transistor M0 in a diode-connected state as in a typical internal compensation.

Figure 6:
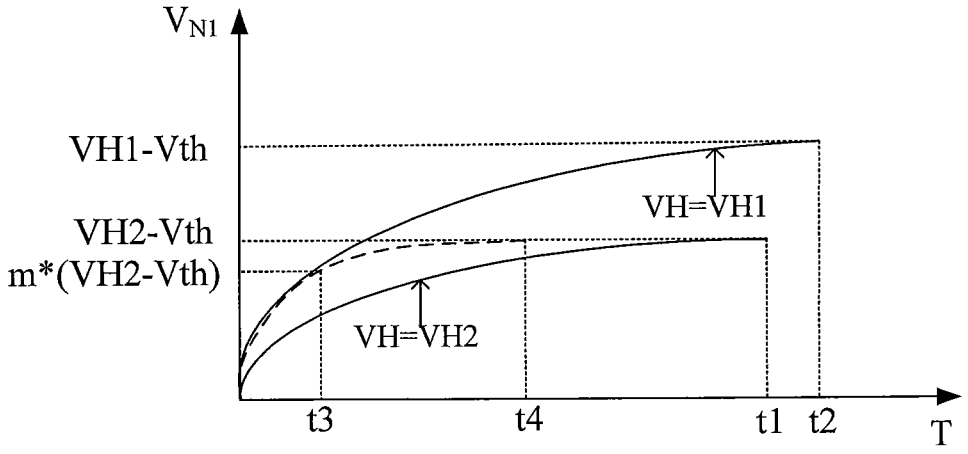
FIG. 6 is an illustration of an overdrive technique used in internal compensation.

As shown in FIG. 5, a so-called overdrive technique may be further adopted in which the storage capacitor Cst is charged with charging voltages VH1 and VH2 (VH1>VH2>Vth) during first and second periods Tc1 and Tc2 of the internal compensation phase COMP. This can be advantageous in that the duration of the internal compensation phase COMP can be shortened. The principle of the overdrive technique is shown in FIG. 6, where the abscissa axis T represents the duration for compensation and the ordinate axis $V_{N1}$ represents the potential at the first node N1. In a first period T21, the storage capacitor Cst is charged with VH1 which is relatively large so that the potential $V_{N1}$ of the first node N1 rises quickly. At time t3, $V_{N1}$ reaches m*(VH2−Vth), where 0<m<1. After that, the second period Tc2 starts, and the charging voltage is changed to VH2 which is relatively small. Since the difference between $V_{N1}$ (which is equal to m*(VH2−Vth)) and the final target voltage (VH2−Vth) is small at this time, $V_{N1}$ can increase to (VH2−Vth) faster, so that the drive transistor M0 enters an off state. It can be seen from FIG. 6 that if the storage capacitor Cst is only charged with VH2, it takes time t1 to bring the drive transistor M0 into an off state, at which point $V_{N1}$=VH2−Vth. If only the VH1 is used to charge the storage capacitor Cst, it takes time t2 to bring the drive transistor M0 into an off state, at which point $V_{N1}$=VH1−Vth. In contrast, in the case of the overdrive technique, it takes only a small amount of time t4 for $V_{N1}$ to increase to (VH2−Vth). Therefore, the overdrive technique allows an accelerated internal compensation without disturbing the display operation of the pixel circuit.

Referring back to FIG. 5, in a data write phase DW that follows, the signal on the first scan line G1[n] is active, so that the data voltage $V_{DATA}$ on the data line D[m] is supplied to the third node N3 (i.e., the gate of the drive transistor M0) through the second transistor M2. Unlike the data write phase DW in FIG. 4, the signal on the second scan line G2[n] is now inactive to prevent the potential $V_{N1}$ at the first node N1 from being reset. The reason that $V_{N1}$ (which is equal to (VH2−Vth)) cannot be reset now is that it contains information on the threshold voltage Vth of the drive transistor M0, which information is necessary to eliminate the threshold voltage Vth term in the above equation (1). At the beginning of the data write phase DW, due to the presence of the capacitors Cst and $C_{OLED}$, $V_{N1}$ transitions from the initial value (VH2−Vth) in response to the transition of the potential at the third node N3 from VH2 to $V_{DATA}$. Specifically, $V_{N1}$ can be calculated as:

$$V_{N1} = VH2 - Vth + (V_{DATA} - VH2) \cdot \frac{C_{st}}{C_{st} + C_{OLED}} \tag{2}$$

In a detection phase DET that follows, the signal on the third scan line G3[n] is active and the signal on the second scan line G2[n] remains active. This allows the driving current generated by the drive transistor M0 to be coupled to the sensing line SL[m] via the third transistor M3 and charge the capacitance presented on the sensing line SL[m]. As shown in FIG. 4, during a first period Td1 of the detection phase DET, the potential Vsense at the first node N1 gradually increases. Due to the self-boosting effect of the storage capacitor Cst, the potential at the third node N3 also gradually increases. In a second period Td2 of the detection phase DET, the signal on the second scan line G2[n] is inactive, such that the sensing line SL[m] is disconnected from the pixel circuit 300A, and the second controlled switch SW2 is turned on. The voltage Vsense on the sensing line SL[m] line is sampled by the analog-to-digital converter ADC and passed to the timing controller 112 shown in FIG. 1. As described above, the timing controller 112 may compensate the image data supplied to the data driver 108 based on the sampled value of the voltage Vsense.

The operation sequence shown in FIG. 5 provides combined advantages of both the internal compensation and the external compensation. In particular, the external compensation can remedy the defects of the internal compensation, taking into account the fact that the internal compensation tends to be not ideal. In practice, the long duration required by the internal compensation generally cannot be satisfied, so that the potential $V_{N1}$ at the first node N1 cannot increase to (VH2−Vth) at the end of the internal compensation phase COMP. This leads to incomplete elimination of the threshold voltage Vth term in equation (1) above. Assuming that $V_{N1}$ only reaches (VH2−Vth*(Vth*>Vth)) at the end of the internal compensation phase COMP, then according to equations (1) and (2), the driving current $I_D$ can be calculated as:

$$I_D = \frac{1}{2}K \times (Vgs - Vth)^{\alpha} = \frac{1}{2}K \times (V_{N3} - V_{N1} - Vth)^{\alpha} = \frac{1}{2}K \times \left(V_{DATA} - \left(VH2 - Vth^{*} + (V_{DATA} - VH2) \cdot \frac{C_{st}}{C_{st} + C_{OLED}}\right) - Vth\right)^{\alpha} = \frac{1}{2}K \times \left((V_{DATA} - VH2) \cdot \frac{C_{OLED}}{C_{st} + C_{OLED}} + Vth^{*} - Vth\right)^{\alpha} \tag{3}$$

It can be seen that the threshold voltage Vth term is not completely eliminated in equation (3). However, this will not be a problem in this document due to the external compensation. By taking into account insufficient internal compensation and even potential shifts of the parameters K and a, the external compensation can provide complementary compensation effects on the basis of the internal compensation.

In addition, given that the internal compensation is able to follow a rapid change in the threshold voltage Vth and, however, has a smaller compensation range, it can be determined whether to perform the internal compensation according to the threshold voltage Vth derived in the external compensation. For example, where the threshold voltage Vth of the drive transistor M0 has a small amount of change (e.g., 0 to 0.1 V) and a large rate of change, the internal compensation may be performed, and where there is a large change in the threshold voltage Vth (e.g., 0 to 3V), the internal compensation may not be performed. By selecting a suitable compensation scheme, the efficiency of compensation can be improved.

The selection of the compensation scheme may be implemented by the timing controller 112 shown in FIG. 1. In some embodiments, the timing controller 112 determines whether an internal compensation condition is satisfied, which internal compensation condition includes: a change rate of the threshold voltage Vth being greater than a change rate threshold and a change amount of the threshold voltage Vth being smaller than a change amount threshold. In response to the internal compensation condition being satisfied, the timing controller 112 may control the pixel circuit to sequentially perform a reset phase, an internal compensation phase, a data write phase, and a light emission phase in each frame period during the display operation. In response to the internal compensation condition being not satisfied, the timing controller 112 may control the pixel circuit to sequentially perform the reset phase, the data write phase, and the light emission phase in each frame period during the display operation.

Figure 7:
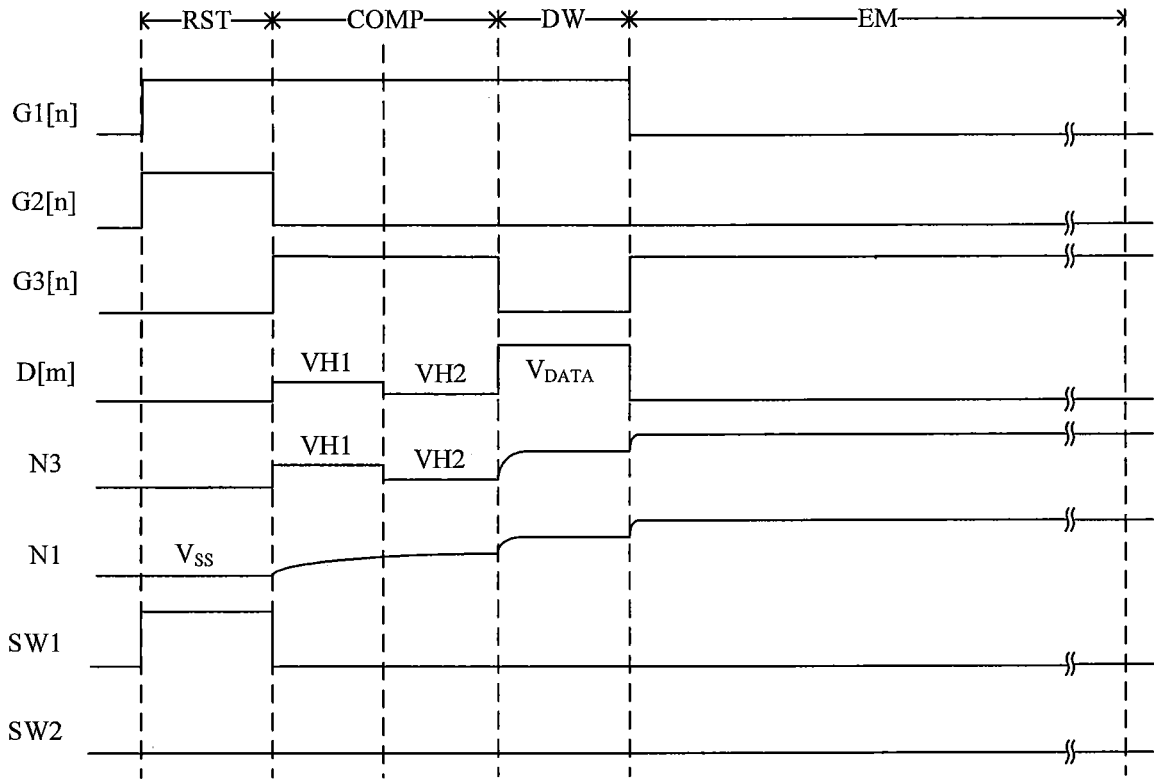
FIG. 7 is a timing diagram for the pixel circuit shown in FIG. 3A during a display operation.

FIG. 7 shows the operation of the pixel circuit 300A shown in FIG. 3A during a display operation, which includes a reset phase RST, an internal compensation phase COMP, a data write phase DW, and a light emission phase EM.

The details of the reset phase RST, the internal compensation phase COMP, and the data write phase DW are similar to those described above with respect to FIG. 5 and are omitted herein for the sake of brevity.

Instead of the detection phase DET in FIG. 5, the light emission phase EM is performed. In the light emission phase EM, the signal on the first scan line G1[*n*] is inactive, the signal on the second scan line G2[*n*] is inactive, and the signal on the third scan line G3[*n*] is active. This allows the driving current generated by the drive transistor M0 to flow through the OLED and drive the OLED to emit light. In addition, in the light emission phase EM, the driving current is not coupled to the sensing line SL[m], and thus it is not necessary to detect the voltage on the sensing line SL[m]. Therefore, the second controlled switch SW2 connected in series with the analog-to-digital converter ADC is always turned off.

Figure 8:
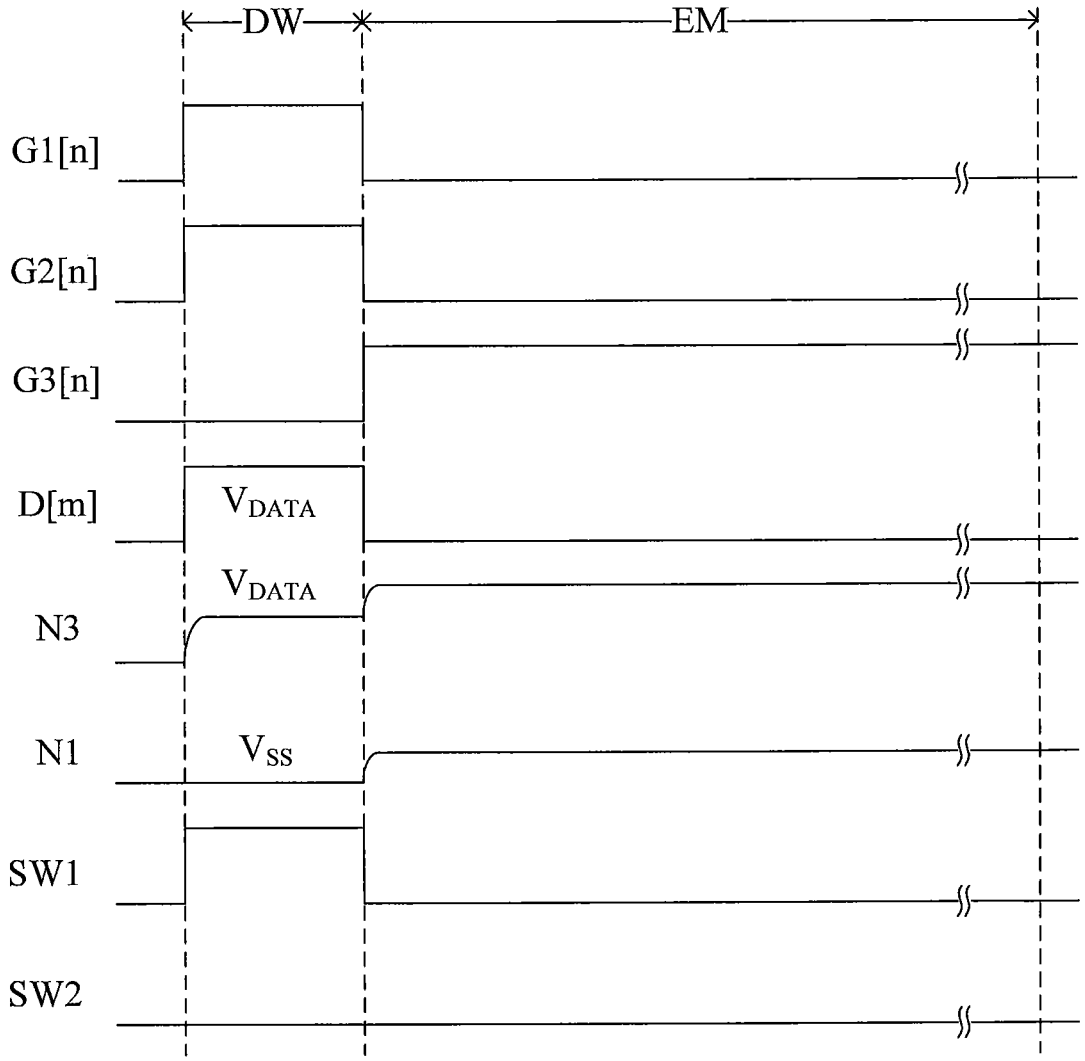
FIG. 8 is another timing diagram for the pixel circuit shown in FIG. 3A during a display operation.

FIG. 8 shows the operation of the pixel circuit 300A shown in FIG. 3A during a display operation in which the internal compensation phase COMP and the reset phase RST are not performed.

The details of the data write phase DW are similar to those described above with respect to FIG. 4 and are omitted here for the sake of brevity.

Instead of the detection phase DET in FIG. 4, the light emission phase EM is performed. In the light emission phase EM, the signal on the first scan line G1[*n*] is inactive, the signal on the second scan line G2[*n*] is inactive, and the signal on the third scan line G3[*n*] is active. This allows the driving current generated by the drive transistor M0 to flow through the OLED and drive the OLED to emit light. As shown in FIG. 8, at the beginning of the light emission phase EM, a small transition occurs in the potential at the first node N1. This is because the OLED is now turned on such that the potential at the first node N1 is clamped at the turn-on voltage of the OLED. Accordingly, the potential at the third node N3 also transitions due to the self-boosting effect of the storage capacitor Cst. In addition, in the light emission phase EM, the driving current is not coupled to the sensing line SL[m], and thus it is not necessary to detect the voltage on the sensing line SL[m]. Therefore, the second controlled switch SW2 connected in series with the analog-to-digital converter ADC is always turned off.

It will be understood that the pixel circuits 300A and 300B described above are exemplary, and that the driving method according to the embodiments of the present disclosure may be applied to other pixel circuit embodiments without departing from the scope of the present disclosure.

It will also be understood that the foregoing is only specific embodiments of the disclosure and is not intended to limit the disclosure. Variations to the disclosed embodiments can be understood and effected by those skilled in the art in practicing the claimed subject matter from a study of the drawings, the disclosure, and the appended claims.

What is claimed is:

1. A method of driving a pixel circuit, the pixel circuit comprising:

a light emitting element connected between a first node and a terminal for receiving a first power supply voltage; a drive transistor connected between the first node and a second node, the drive transistor comprising a gate, a source, and a drain, the gate being connected to a third node; a storage capacitor connected between the gate and the source of the drive transistor; a first switch circuit connected to a third scan line, a terminal for receiving a second power supply voltage, and the second node, the first switch circuit being configured to supply the second power supply voltage to the second node in response to a third scan signal on the third scan line being active; a second switch circuit connected to a first scan line, a data line, and the third node, the second switch circuit being configured to supply a voltage on the data line to the third node in response to a first scan signal on the first scan line being active; and a third switch circuit connected to a second scan line, a sensing line, and the first node, the third switch circuit being configured to couple the first node to the sensing line in response to a second scan signal on the second scan line being active, the method comprising:

performing a data write phase comprising:

bringing, by the first switch circuit, the second node out of conduction with the terminal for receiving the second power supply voltage by deactivating the third scan signal on the third scan line; and charging the storage capacitor via the second switch circuit with a data voltage applied to the data line by activating the first scan signal on the first scan line, and performing a detection phase comprising:

directing, via the third switch circuit, a driving current generated by the drive transistor based on the data voltage to the sensing line by activating the third scan signal on the third scan line and the second scan signal on the second scan line; and detecting a magnitude of the driving current.

2. The method of claim 1, wherein the drive transistor is an N-type transistor, wherein the source of the drive transistor is connected to the first node, and wherein the drain of the drive transistor is connected to the second node.

3. The method of claim 2, wherein the performing the data write phase further comprises:

supplying, via the third switch circuit, a reference voltage applied to the sensing line to the first node by activating the second scan signal on the second scan line.

4. The method of claim 2, further comprising:

performing a reset phase and an internal compensation phase prior to the data write phase, wherein the performing the reset phase comprises:

supplying, via the second switch circuit, a reset voltage applied to the data line to the third node by activating the first scan signal on the first scan line; and supplying, via the third switch circuit, a reference voltage applied to the sensing line to the first node by activating the second scan signal on the second scan line;

wherein the performing the internal compensation phase comprises:

charging the storage capacitor via the second switch circuit with a charging voltage applied to the data line by activating the third scan signal on the third scan line, by deactivating the second scan signal on the second scan line, and by activating the first scan signal on the scan line; and wherein the performing the data write phase further comprises deactivating the second scan signal on the second scan line.

5. The method of claim 4, wherein the charging the storage capacitor with the charging voltage comprises:

in a first period of time, charging the storage capacitor with a first charging voltage by applying the first charging voltage to the data line; and in a second period of time subsequent to the first period of time, charging the storage capacitor with a second charging voltage by applying the second charging voltage to the data line, wherein the first charging voltage is greater than the second charging voltage, and wherein the second charging voltage is greater than a threshold voltage of the drive transistor.

6. The method of claim 2, wherein the performing the detection phase further comprises:

deriving a threshold voltage of the drive transistor based on the detected magnitude of the driving current; and determining whether an internal compensation condition is satisfied, wherein the internal compensation condition comprises: a change rate of the threshold voltage being greater than a change rate threshold, and a change amount of the threshold voltage being smaller than a change amount threshold, and wherein the method further comprises:

responsive to the internal compensation condition being satisfied, sequentially performing a reset phase, an internal compensation phase, the data write phase, and a light emission phase in each frame period during a display operation, wherein the performing the data write phase further comprises deactivating the second scan signal on the second scan line; and responsive to the internal compensation condition being not satisfied, sequentially performing the reset phase, the data write phase, and the light emission phase in each frame period during the display operation, wherein the performing the data write phase further comprises supplying, via the third switch circuit, a reference voltage applied to the sensing line to the first node by activating the second scan signal on the second scan line.

7. The method of claim 6, wherein the performing the reset phase comprises:

supplying, via the second switch circuit, a reset voltage applied to the data line to the third node by activating the first scan signal on the first scan line; and supplying, via the third switch circuit, the reference voltage applied to the sensing line to the first node by activating the second scan signal on the second scan line;

wherein the performing the internal compensation phase comprises charging the storage capacitor via the second switch circuit with a charging voltage on the data line by activating the third scan signal on the third scan line, by deactivating the second scan signal on the second scan line, and by activating the first scan signal on the first scan line; and wherein the performing the light emission phase comprises driving the light emitting element to emit light with the driving current generated by the drive transistor by deactivating the first scan signal on the first scan line, by deactivating the second scan signal on the second scan line, and by activating the third scan signal on the third scan line.

8. The method of claim 7, wherein the charging the storage capacitor with the charging voltage comprises:

in a first period of time, charging the storage capacitor with a first charging voltage by applying the first charging voltage to the data line; and in a second period of time subsequent to the first period of time, charging the storage capacitor with a second charging voltage by applying the second charging voltage to the data line, wherein the first charging voltage is greater than the second charging voltage, and wherein the second charging voltage is greater than the threshold voltage of the drive transistor.

9. A display device, comprising:

a first scan driver configured to sequentially supply first scan signals to a plurality of first scan lines;

a second scan driver configured to sequentially supply second scan signals to a plurality of second scan lines;

a third scan driver configured to sequentially supply third scan signals to a plurality of third scan lines;

a data driver configured to generate output voltages based on input data and apply the generated output voltages to a plurality of data lines;

a pixel array comprising a plurality of pixel circuits arranged in an array, each of the pixel circuits comprising:

a light emitting element connected between a first node and a terminal for receiving a first power supply voltage;

a drive transistor connected between the first node and a second node, the drive transistor comprising a gate, a source, and a drain, the gate being connected to a third node;

a storage capacitor connected between the gate and the source of the drive transistor;

a first switch circuit connected to a corresponding one of the plurality of third scan lines, a terminal for receiving a second power supply voltage, and the second node, the first switch circuit being configured to supply the second power supply voltage to the second node in response to the third scan signal on the corresponding third scan line being active;

a second switch circuit connected to a corresponding one of the plurality of first scan lines, a corresponding one of the plurality of data lines, and the third node, the second switch circuit being configured to supply a voltage on the corresponding data line to the third node in response to the first scan signal on the corresponding first scan line being active; and a third switch circuit connected to a corresponding one of the plurality of second scan lines, a corresponding one of the plurality of sensing lines, and the first node, the third switch circuit being configured to couple the first node to the corresponding sensing line in response to the second scan signal on the corresponding second scan line being active;

a plurality of detection circuits each connected to a corresponding one of the plurality of sensing lines, each of the plurality of detection circuits being configured to detect a driving current generated by the drive transistor and transferred by the corresponding sensing line; and a timing controller configured to control operations of the first, second, and third scan drivers, the data driver, and the plurality of detection circuits, wherein the timing controller, the first, second, and third scan drivers, the data driver, and the plurality of detection circuits are configured to perform operations for each of the plurality of pixel circuits, the operations comprising:

performing a data write phase in which the third scan driver is configured to supply an inactive third scan signal to the corresponding third scan line such that the first switch circuit brings the second node out of conduction with the terminal for receiving the second power supply voltage, and the first scan driver is configured to supply an active first scan signal to the corresponding first scan line and the data driver is configured to apply a data voltage to the corresponding data line such that the storage capacitor is charged with the data voltage via the second switch circuit; and performing a detection phase in which the third scan driver is configured to supply an active third scan signal to the corresponding third scan line, the second scan driver is configured to supply an active second scan signal to the corresponding second scan line such that the driving current generated by the drive transistor based on the data voltage is directed to the corresponding sensing line via the third switch circuit, and a corresponding one of the plurality of detection circuits is configured to detect a magnitude of the driving current.

10. The display device of claim 9, wherein the drive transistor is an N-type transistor, wherein the source of the drive transistor is connected to the first node, and wherein the drain of the drive transistor is connected to the second node.

11. The display device of claim 10, wherein, in the data write phase, the second scan driver is configured to supply an active second scan signal to the corresponding second scan line and the corresponding detection circuit is configured to apply a reference voltage to the corresponding sensing line such that the reference voltage is supplied to the first node via the third switch circuit.

12. The display device of claim 10, wherein the operations further comprise performing a reset phase and an internal compensation phase prior to the data write phase, wherein in the reset phase, the first scan driver is configured to supply an active first scan signal to the corresponding first scan line, and the data driver is configured to supply a reset voltage to the corresponding data line such that the reset voltage is supplied to the third node via the second switch circuit, the second scan driver is configured to supply an active second scan signal to the corresponding second scan line, and the corresponding detection circuit is configured to apply a reference voltage to the corresponding sensing line such that the reference voltage is supplied to the first node via the third switch circuit;

wherein in the internal compensation phase: the third scan driver is configured to supply an active third scan signal to the corresponding third scan line, the second scan driver is configured to supply an inactive second scan signal to the corresponding second scan line, the first scan driver is configured to supply an active first scan signal to the corresponding first scan line, and the data driver is configured to apply a charging voltage to the corresponding data line, such that the storage capacitor is charged with the charging voltage via the second switch circuit; and wherein in the data write phase, the second scan driver is configured to supply an inactive second scan signal to the corresponding second scan line.

13. The display device of claim 12, wherein in the internal compensation phase, the data driver is further configured to:

in a first period of time, apply a first charging voltage to the corresponding data line such that the storage capacitor is charged with the first charging voltage; and in a second period of time subsequent to the first period of time, apply a second charging voltage to the corresponding data line such that the storage capacitor is charged with the second charging voltage, wherein the first charging voltage is greater than the second charging voltage, and wherein the second charging voltage is greater than a threshold voltage of the drive transistor.

14. The display device of claim 10, wherein in the detection phase, the timing controller is configured to derive a threshold voltage of the drive transistor based on the detected magnitude of the driving current and determine whether an internal compensation condition is satisfied, the internal compensation condition comprising a change rate of the threshold voltage being greater than a change rate threshold, and a change amount of the threshold voltage being less than a change amount threshold, the operations further comprising:

responsive to the internal compensation condition being satisfied, sequentially performing a reset phase, an internal compensation phase, the data write phase, and a light emission phase in each frame period during a display operation, wherein in the data write phase, the second scan driver is configured to supply an inactive second scan signal to the corresponding second scan line; and responsive to the internal compensation condition being not satisfied, sequentially performing the reset phase, the data write phase, and the light emission phase in each frame period during the display operation, wherein in the data write phase, the second scan driver is configured to supply an active second scan signal to the corresponding second scan line and the corresponding detection circuit is configured to apply a reference voltage to the corresponding sensing line such that the reference voltage is supplied to the first node via the third switch circuit.

15. The display device of claim 14, wherein in the reset phase the first scan driver is configured to supply an active first scan signal to the corresponding first scan line and the data driver is configured to apply a reset voltage to the corresponding data line such that the reset voltage is supplied to the third node via the second switch circuit, the second scan driver is configured to supply an active second scan signal to the corresponding second scan line, and the corresponding detection circuit is configured to apply the reference voltage to the corresponding sensing line such that the reference voltage is supplied to the first node via the third switch circuit;

wherein in the internal compensation phase the third scan driver is configured to supply an active third scan signal to the corresponding third scan line, the second scan driver is configured to supply an inactive second scan signal to the corresponding second scan line, the first scan driver is configured to supply an active first scan signal to the corresponding first scan line, and the data driver is configured to apply a charging voltage to the corresponding data line, such that the storage capacitor is charged with the charging voltage via the second switch circuit; and wherein in the light emission phase the first scan driver is configured to supply an inactive first scan signal to the corresponding first scan line, the second scan driver is configured to supply an inactive second scan signal to the corresponding second scan line, and the third scan driver is configured to supply an active third scan signal to the corresponding third scan line, such that the light emitting element is driven to emit light by the driving current generated by the drive transistor.

16. The display device of claim 15, wherein in the internal compensation phase, the data driver is further configured to:

in a first period of time, apply a first charging voltage to the corresponding data line such that the storage capacitor is charged with the first charging voltage; and in a second period of time subsequent to the first period of time, apply a second charging voltage to the corresponding data line such that the storage capacitor is charged with the second charging voltage, wherein the first charging voltage is greater than the second charging voltage, and wherein the second charging voltage is greater than the threshold voltage of the drive transistor.

17. The display device of claim 9, wherein the drive transistor is a P-type transistor, wherein the source of the drive transistor is connected to the second node, and wherein the drain of the drive transistor is connected to the first node.

18. The display device of claim 9, wherein the first switch circuit comprises a first transistor having a gate connected to the corresponding third scan line, a first electrode connected to the terminal for receiving the second power supply voltage, and a second electrode connected to the second node.

19. The display device of claim 9, wherein the second switch circuit comprises a second transistor having a gate connected to the corresponding first scan line, a first electrode connected to the corresponding data line, and a second electrode connected to the third node.

20. The display device of claim 9, wherein the third switch circuit comprises a third transistor having a gate connected to the corresponding second scan line, a first electrode connected to the corresponding sensing line, and a second electrode connected to the first node.

* * * * *